US006361288B1

(12) United States Patent
Sperry

(10) Patent No.: US 6,361,288 B1
(45) Date of Patent: Mar. 26, 2002

(54) VARIABLE CLEARANCE SYSTEM FOR RECIPROCATING COMPRESSORS

(75) Inventor: Lauren D. Sperry, Blue Springs, MO (US)

(73) Assignee: Gas & Air Specialty Products, Blue Springs, MO (US)

( * ) Notice: Subject to any disclaimer, the term of this patent is extended or adjusted under 35 U.S.C. 154(b) by 0 days.

(21) Appl. No.: 09/481,887

(22) Filed: Jan. 12, 2000

(51) Int. Cl.[7] ..... F04B 49/00; F16K 15/00
(52) U.S. Cl. ..... 417/307; 417/298; 137/522
(58) Field of Search ..... 417/307, 298, 417/308, 536; 137/522, 523

(56) References Cited

U.S. PATENT DOCUMENTS

| | | | | | |
|---|---|---|---|---|---|
| 3,584,981 | A | * | 6/1971 | Worster | 417/542 |
| 4,569,367 | A | * | 2/1986 | Petro | 137/596.13 |
| 4,737,080 | A | * | 4/1988 | Owsley et al. | 417/275 |
| 5,421,358 | A | * | 6/1995 | Jaeger | 137/1 |
| 5,695,325 | A | * | 12/1997 | Sperry | 417/53 |

FOREIGN PATENT DOCUMENTS

| | | | | |
|---|---|---|---|---|
| JP | 62-178784 | * | 8/1987 | F04B/41/02 |

* cited by examiner

*Primary Examiner*—Charles G. Freay
*Assistant Examiner*—Michael K. Gray
(74) *Attorney, Agent, or Firm*—Shugart Thomson & Kilroy, P.C.

(57) ABSTRACT

An unloader system is provided for a reciprocating gas compressor having a cylinder, a piston reciprocably mounted in the cylinder, a rotatable crankshaft connected to the piston, a suction valve assembly, and a discharge valve assembly for selectively communicating suction and discharge lines with the compressor cylinder. An unloader valve assembly including a valve seat structure, valve guard, and multiple poppet valve members is provided to allow selective communication between the compressor cylinder and a clearance bottle. The opening and closing of the unloader valve assembly is controlled by manipulating a control pressure acting through a manifold against the stem ends of the poppet valve members by means of a pressure regulator connected in series with a pressure source. When the pressure in the compressor cylinder acting on the heads of the poppet valve members exceeds the control pressure acting on the stems, the poppet valve members open, partially unloading the compressor.

19 Claims, 11 Drawing Sheets

PARTIAL USE OF FIXED VOLUME CLEARENCE

VARIABLE CLEARANCE SYSTEM FOR RECIPROCATING COMPRESSORS

BACKGROUND OF THE INVENTION

1. Field of the Invention

The present invention relates generally to unloaders for reciprocating gas compressors, and in particular to an unloader system that allows variable use of fixed or variable clearance volumes.

2. Description of the Related Art

Gas compressors are well known and various types have been utilized to meet the requirements of particular applications. For example, natural gas transmission through pipelines is often accomplished with large, reciprocating compressors driven by internal combustion engines at pumping stations located along the pipeline routes.

In natural gas transmission, the internal combustion engines which drive the compressors are often fueled by natural gas taken directly from the pipeline. Thus, the fuel consumed by the engines driving the compressors reduces the overall operating efficiency since the amount of gas delivered is reduced by amounts consumed in the transmission or pumping process.

Efficient operation of natural gas compressors typically involves the use of a computerized control system for controlling the air/fuel mixture, rotational speeds, etc. Another factor which has a significant effect on compressor operating efficiency relates to the extent to which the compressor is loaded. In fully-loaded operation, the maximum output of the compressor is achieved, with a resultant full load on the compressor engine. However, natural gas compressor flow demands can vary considerably, and typically depend on downstream demand factors and conditions.

Controlling compressor flow is often accomplished by partially "unloading" a compressor whereby each compressor stroke produces a reduced gas flow as compared to fully-loaded operation. Reduced gas flow generally corresponds to reduced work performed by the compressor engine, whereby fuel savings and greater efficiency can be achieved. Although compressor output could be varied by changing the speed of the driving engine, this approach is often impractical because the engines are designed to operate at constant speeds for maximum fuel efficiency and minimum emissions. Thus, compressor output control must normally be accomplished using other means.

A compressor can be partially unloaded and its output reduced by increasing the clearance volume. Clearance bottles connected to compressor cylinders via valves are often provided for this purpose. The Owsley et al. U.S. Pat. No. 4,737,080, which is incorporated herein by reference, discloses an unloader of this type wherein the valve members are controlled by means of a pilot valve. The pilot valve may be positioned so as to either apply suction line pressure to the valve members, holding them in the closed position and thereby loading the compressor, or to vent the valve assembly, allowing the valve members to open and thereby partially unload the compressor.

A problem with this type of clearance bottle unloader system is that the valves are required to be held fully open or fully closed for continuous operation in one mode or the other, and cannot be used in a variable manner that cycles with each revolution of the compressor.

The Sperry U.S. Pat. No. 5,695,325, which is incorporated herein by reference, discloses an unloader system wherein the compressor may be unloaded in steps during operation by rotating a valve guard mounting the valve members in synchronization with the compressor crankshaft. This is accomplished using a stepper motor keyed to the compressor's crankshaft position to actuate a radial unloader valve assembly. While this arrangement does allow the compressor to be loaded and unloaded with each revolution of the compressor crankshaft, the mechanism is not suited for every compressor unloading application.

The present invention relates to pneumatically loading and unloading a reciprocating compressor in a smooth, stepless manner with each revolution of the crankshaft. This is accomplished by using a controlled pressure to hold the unloader valves closed until the compressor piston reaches the desired position in its cycle. By adjusting the set point of a pressure regulator, the effective use of any shape and size of clearance cavity can be smoothly varied from zero impact to full impact.

Heretofore there has not been a compressor unloader system available with the advantages and features of the present invention.

SUMMARY OF THE INVENTION

In the practice of the present invention, an unloader system is provided for a reciprocating gas compressor having a cylinder, a piston reciprocably mounted in the cylinder, a rotatable crankshaft connected to the piston, a suction valve assembly, and a discharge valve assembly for selectively communicating suction and discharge lines with the compressor cylinder. An unloader valve assembly including a valve seat structure, a valve guard, and multiple poppet valve members is provided to allow selective communication between the compressor cylinder and a clearance bottle. The opening and closing of the unloader valve assembly is controlled by manipulating a control pressure acting through a manifold against the stem ends of the poppet valve members by means of a pressure regulator connected in series with a pressure source. When the pressure in the compressor cylinder acting on the heads of the poppet valve members exceeds the control pressure acting on the stems, the poppet valve members open, partially unloading the compressor.

OBJECTS AND ADVANTAGES OF THE INVENTION

The principal objects and advantages of the present invention include: providing an unloader system for a gas compressor; providing such an unloader system which operates in a relatively smooth, stepless manner to vary compressor loading with clearance pockets; providing such an unloader system which makes partial use of fixed clearance volumes; providing such an unloader system which provides essentially infinite unloading capabilities; providing such an unloader system which can cycle with each revolution of the compressor crankshaft without reference to the crankshaft position; providing such an unloader system where the set point at which the clearance cavity is opened is quickly and easily adjustable; providing such an unloader system which can be utilized with various types of valve assemblies; providing such an unloader system which is economical to manufacture, efficient in operation, capable of long operating life and particularly well-adapted for the proposed usage thereof.

DETAILED DESCRIPTION OF THE PREFERRED EMBODIMENTS

I. INTRODUCTION AND ENVIRONMENT

Figure 1:
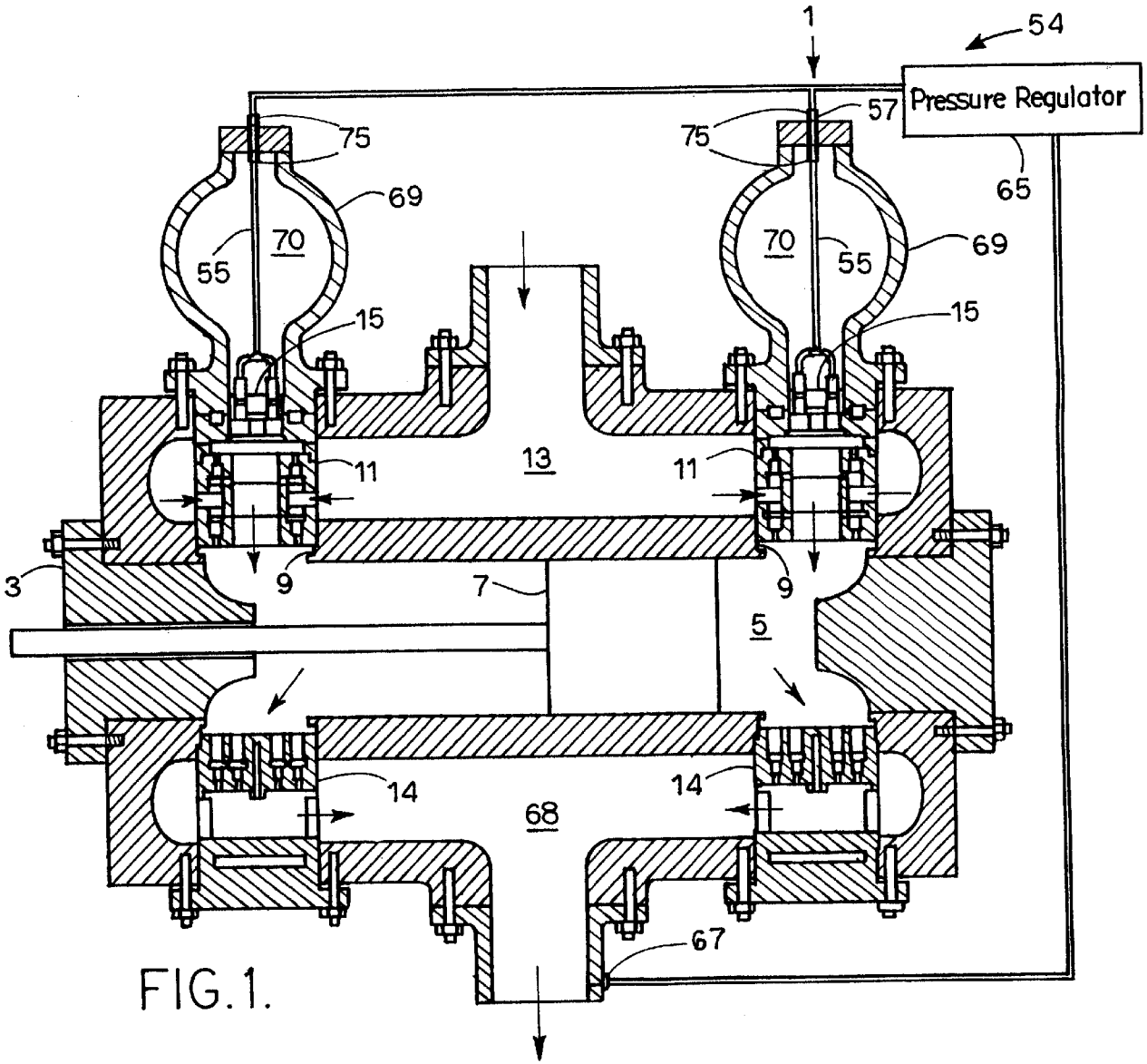
FIG. 1 is a cross-sectional view of a reciprocating gas compressor with the unloader system embodying the present invention installed in two suction valve pockets thereof.
Figure 2:
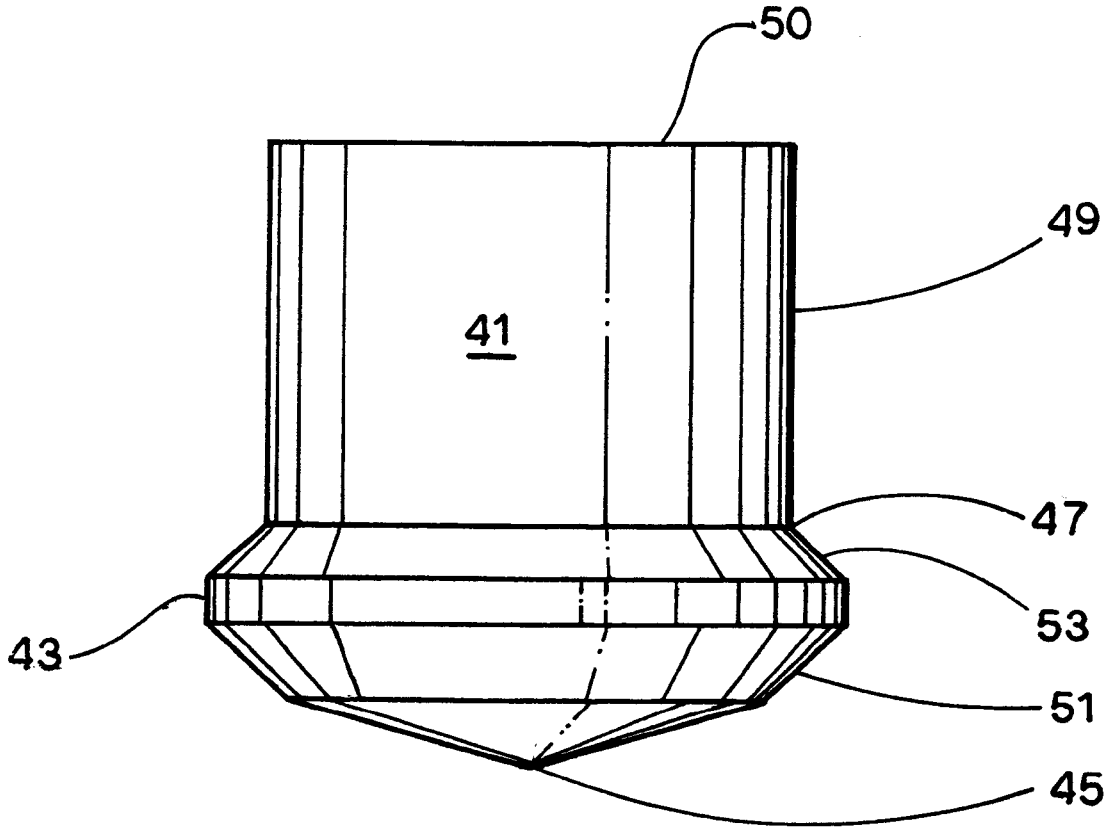
FIG. 2 is an enlarged, cross-sectional view of a poppet valve member thereof.
Figure 3:
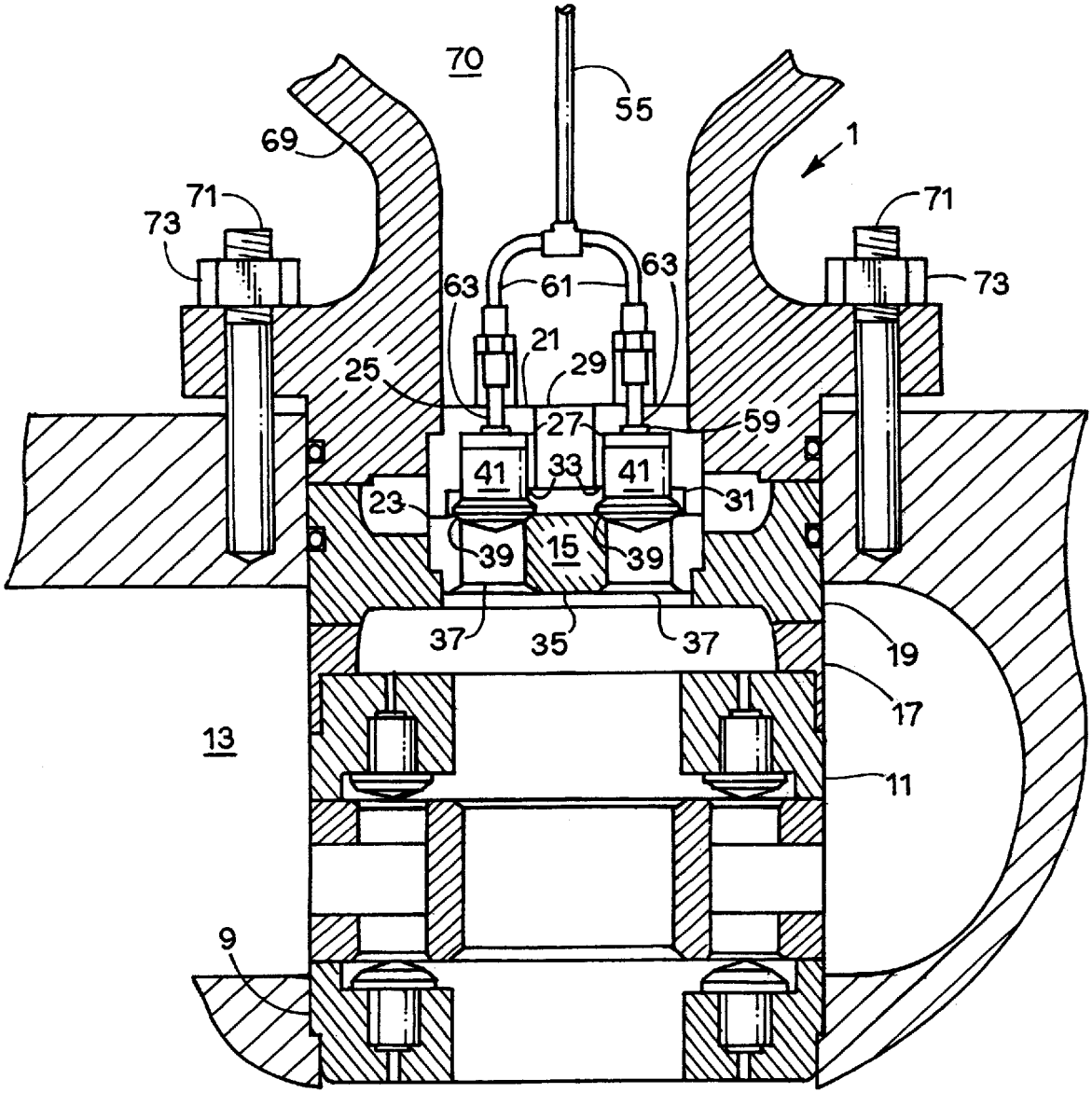
FIG. 3 is a partial, enlarged, cross-sectional view of an unloader system including the clearance bottle and the suction valve assembly thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

In particular, the preferred embodiments disclosed herein and illustrated in the drawings all show unloader valve assemblies with poppet valve members. This use of poppet valve members is for illustrative purposes only and should not be considered to be limiting. The present invention could be embodied with other types of valves such as plate valves (circular rings sealing over circular slots) or strip valves (flat or curved strips sealing over linear slots).

Referring to the drawings in more detail, the reference number 1 generally designates an unloader system embodying the present invention. The unloader system 1 is adapted for use in connection with a reciprocating compressor 3 including a cylinder 5 reciprocably receiving a piston 7. Suction valve pockets 9 are formed at either end of the cylinder 5. Suction valve assemblies 11, installed in the suction valve pockets 9, selectively communicate the suction line 13 with the cylinder 5. Discharge valve assemblies 14 selectively communicate the cylinder 5 with the discharge line 68.

II. UNLOADER SYSTEM 1

The unloader system 1 includes an unloader valve assembly 15 which is mounted in a suction valve pocket 9 by means of an adapter 17 and a reducer 19, placing it in communication with the cylinder 5 through the suction valve assembly 11. The unloader valve assembly 15 includes a valve guard 21 having inboard and outboard sides 23, 25, a pair of poppet valve stem bores 27, a fluid passage 29, and a valve head clearance 31. Each poppet valve stem bore 27 has a chamfered valve seat 33.

A valve seat structure 35 is mounted to the inboard side 23 of the valve guard 21. The valve seat structure 35 has seat passages 37 in alignment with the valve stem bores 27 in the valve guard 21. Each valve seat passage 37 has a chamfered valve seat 39.

Poppet valve members 41 are moveably mounted in each of the valve stem bores 27. Each poppet valve member 41 has a head 43 with an inboard side 45 and an outboard side 47; and a stem 49 having a face 50. The inboard side 45 of the head 43 has a beveled seating surface 51 for engaging the chamfered valve seat 39 of the seat passage 37 in the poppet valve member's closed position. The outboard side 47 of the head 43 has a similar beveled seating surface 53 for engaging the chamfered valve seat 33 of the poppet valve stem bore 27 in the poppet valve member's open position. Preferably, the poppet valve members 41 will be made of a non-metallic material, as this will help to prevent damage to the chamfered valve seats 33, 39 caused by repeated contact with the poppet valve members 41.

The unloader valve assembly 15 may include pressure relief grooves as disclosed by Bunn et al. U.S. Pat. No. 4,398,559 or head-guided poppet valve members as disclosed by Owsley et al. U.S. Pat. No. 4,819,689. Those patents are incorporated herein by reference.

The unloader valve assembly 15 opens and closes in response to the pressure differential acting on opposing sides of the poppet valve member 41 (i.e., on the valve stem face 50 and the inboard side 45 of the head 43). The pressure acting on the inboard side 45 of the head 43 is the pressure $P_{cyl}$ within the cylinder 5 of the compressor 3, which is an operating condition of the compressor 3 and varies with the cycling of the compressor 3.

The pressure $P_{ctrl}$ acting on the valve stem face 50 is governed by a control system 54 which is fully described herein as being pneumatic, but which could also be hydraulic or electro-mechanical. In the pneumatic version, a control manifold 55, having an outboard end 57 and an inboard end 59 with a branch 61 for each poppet valve stem bore 27, communicates with the poppet valve stem bores 27 through ports 63 in the inboard side 23 of the valve guard 21. The outboard end 57 of the control manifold 55 is in communication with a pressure regulator 65, which is also in communication with a pressure source 67.

The pressure regulator 65 can be adjusted to vary the control pressure set point $P_{ctrl}$ in response to the operating conditions of the compressor 3. These operating conditions can include downstream demand for natural gas, the fuel consumption of the engine driving the compressor, the level of exhaust emissions from the engine driving the compressor or the concentration of any selected component of those emissions (such as NOX), rotational speed of the compressor, compressor crankshaft position, pressure within the cylinder $P_{cyl}$, suction pressure $P_{suct}$, discharge pressure $P_{disc}$, or any other condition which might dictate the desired output of the compressor 3.

If the poppet valve stem bores 27 and the seat passages 37 are the same diameter, then substantially identical pressures acting on the identical cross sectional areas (i.e., on the valve stem face 50 and the inboard side 45 of the head 43 of the poppet valve member 41) will produce the same force. In this configuration, the pressure source 67 could be the discharge line 68 of the compressor 3, because the discharge pressure $P_{disc}$ would theoretically represent the highest pressure that should be required to operate the unloader system 1, although slightly higher pressures might be required to overcome valve resistance and inertia of the poppet valve members 41.

Each poppet valve member 41 can optionally be equipped with a helical return spring 52 for biasing it towards its closed position. Alternatively, springs can be provided for biasing the poppet valve members towards their open positions. If springs 52 are included, then factors such as a spring constant ("K") could affect the unloader control pressure set points.

A clearance bottle 69 is fastened over the suction valve pocket 9 by means of studs 71 and nuts 73. The interior of the clearance bottle 69 defines a clearance cavity 70. As the nuts 73 are tightened, the suction valve assembly 11, the adapter 17, the reducer 19, the unloader valve seat structure 35, the unloader valve guard 21, and the clearance bottle 69 are drawn together and firmly positioned in the suction valve pocket 9. The control manifold 55 passes through the clearance bottle 69, and the joint is sealed with pressure-tight fittings 75.

In operation, the pressure regulator 65 is adjusted to a control pressure set point $P_{ctrl}$, holding the poppet valve members 41 in their closed positions. When the poppet valve members 41 are in their closed positions, the clearance cavity 70 is isolated from the compressor cylinder 5. As the piston 7 approaches the top of the cylinder 5, the pressure $P_{cyl}$ in the cylinder 5 builds until it exceeds the control pressure set point $P_{ctrl}$, at which point the poppet valve members 41 are forced open, partially unloading the compressor 3 by placing the cylinder 5 in communication with the clearance cavity 70. In the open position, the outboard beveled seating surfaces 53 of poppet valve members 41 are pressed firmly against the chamfered valve seats 33 of the valve guard 21, seating the control manifold 55 off from the clearance cavity 70. By adjusting the pressure regulator 65, the poppet valve members 41 can be set to open at any point in the stroke of the piston 7.

It should be noted that while this discussion only describes the pressure regulator 65 controlling a single unloader valve assembly 15 per stage of the compressor 3, one pressure regulator 65 can be used to control multiple unloader valve assemblies 15 on a single stage of the compressor 3, Each unloader valve assembly 15 may be in communication with a separate clearance bottle 69.

III. FIRST MODIFIED EMBODIMENT UNLOADER SYSTEM 101

Figure 4:
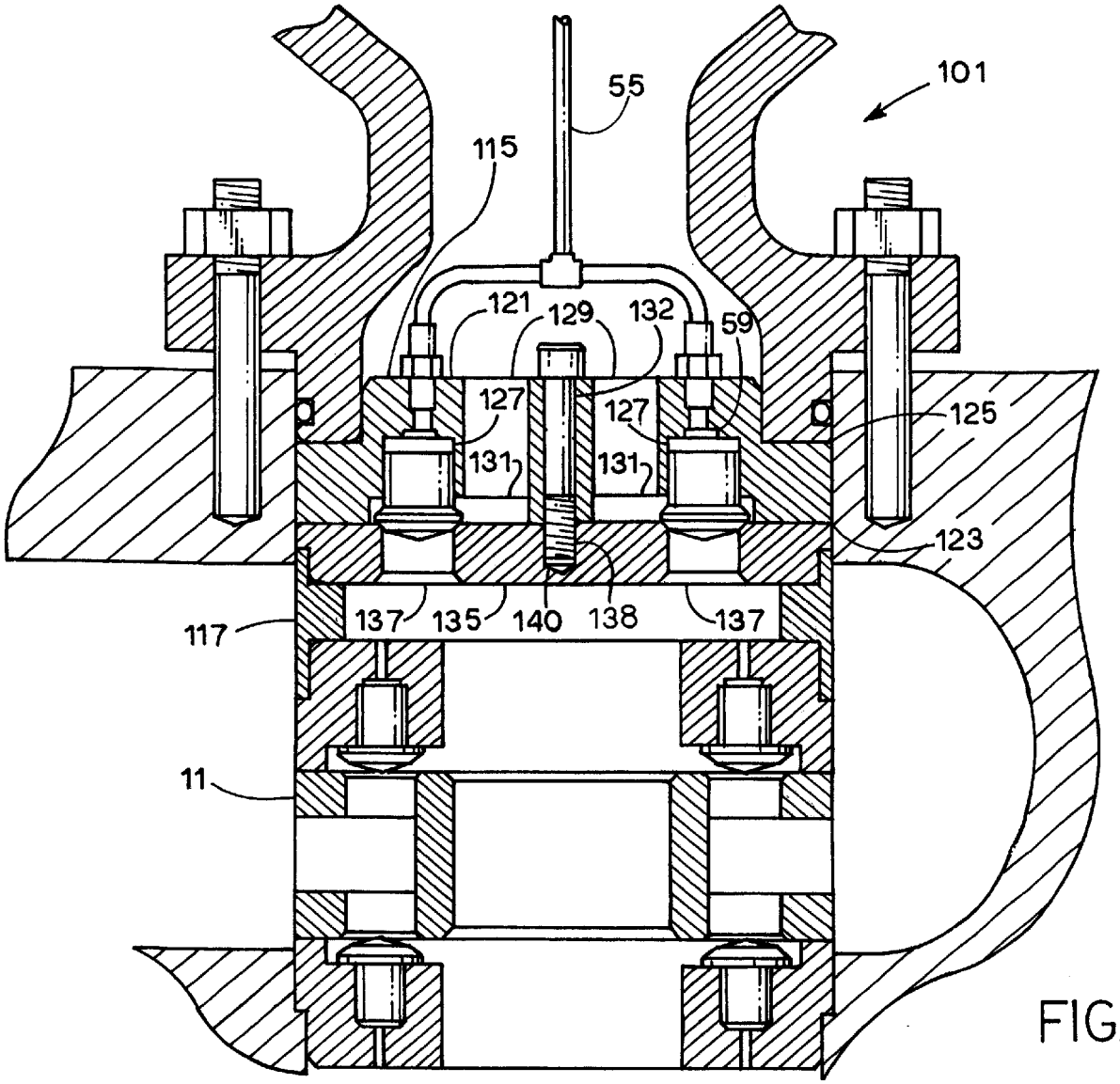
FIG. 4 is a partial, enlarged, cross-sectional view of an unloader system comprising a first modified embodiment of the present invention including a modified unloader valve assembly.

An unloader system 101 comprising a first modified embodiment of the present invention is shown in FIG. 4 and includes an unloader valve assembly 115 which is mounted in the suction valve pocket 9 by means of an adapter 117. The unloader valve assembly 115 includes a valve guard 121 having inboard and outboard sides 123, 125, and a pair of poppet valve stem bores 127. Each poppet valve stem bore 127 is associated with a fluid passage 129, and a valve head clearance 131. The valve guard 121 has a center hole 132.

A valve seat structure 135 is mounted to the inboard side 123 of the valve guard 121. The valve seat structure 135 has seat passages 137 in alignment with the valve stem bores 127 of the valve guard 121 and a threaded receiver 138 in alignment with the center hole 132 of the valve guard 121. An axial attaching bolt 140 passes through the center hole 132 of the valve guard 121 and threadably engages the threaded receiver 138 of the valve seat structure 135.

IV. OPERATION OF THE UNLOADER SYSTEM 1 OR 101

Figure 5:
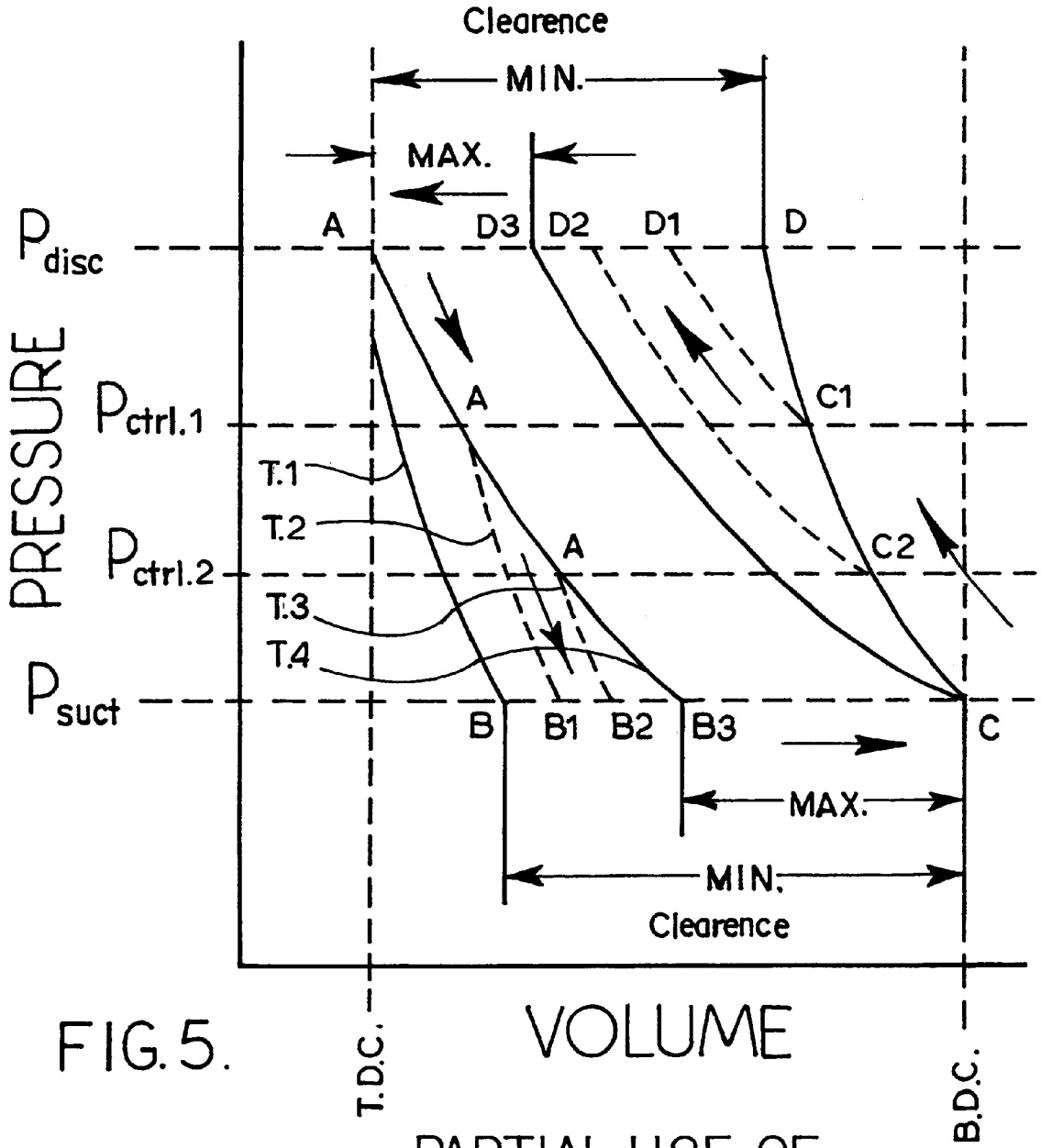
FIG. 5 is a Pressure-Volume (PV) graph or trace showing the operation of the unloader system.

The operation of the compressor 3 and the unloader system 1 is represented by a pressure/volume graph, commonly referred to as a "PV trace". FIG. 5 shows a PV trace depicting pressure and volume conditions with various conditions of the clearance cavity 70 communicating with the cylinder 5. It should be noted that FIG. 5 is a theoretical depiction of the perfect operation of the compressor 3 and makes no allowances for resistance from friction and inertia of the poppet valve members 41.

Trace T.1 (A-B-C-D-A) represents a fully-loaded, minimum clearance operating condition with the clearance cavity 70 closed off from the cylinder 5. PV trace T.4 (A-B3-C-D3-A) depicts a maximum clearance condition with the clearance cavity 70 in continuous communication with the compressor cylinder 5. The highest pressure attained at any point in the cycle is the discharge pressure $P_{disc}$ which represents the pressure in the discharge line 68. The lowest pressure in the cycle is the suction line pressure $P_{suct}$.

Intermediate PV traces T.2 and T.3 show how the cycle can be modified by employing the unloader system 1. Trace T.2 (A-A1-B1-C-C1-D1-A) represents the unloader valve assembly 15 being opened at C1 and closed at A1. This can be accomplished by setting the pressure regulator 65 to a control pressure set point $P_{ctrl.1}$. Both opening and closing would occur at approximately the same pressure as depicted by the location of A1 and C1 on the same pressure line in FIG. 5.

Figure 5A:
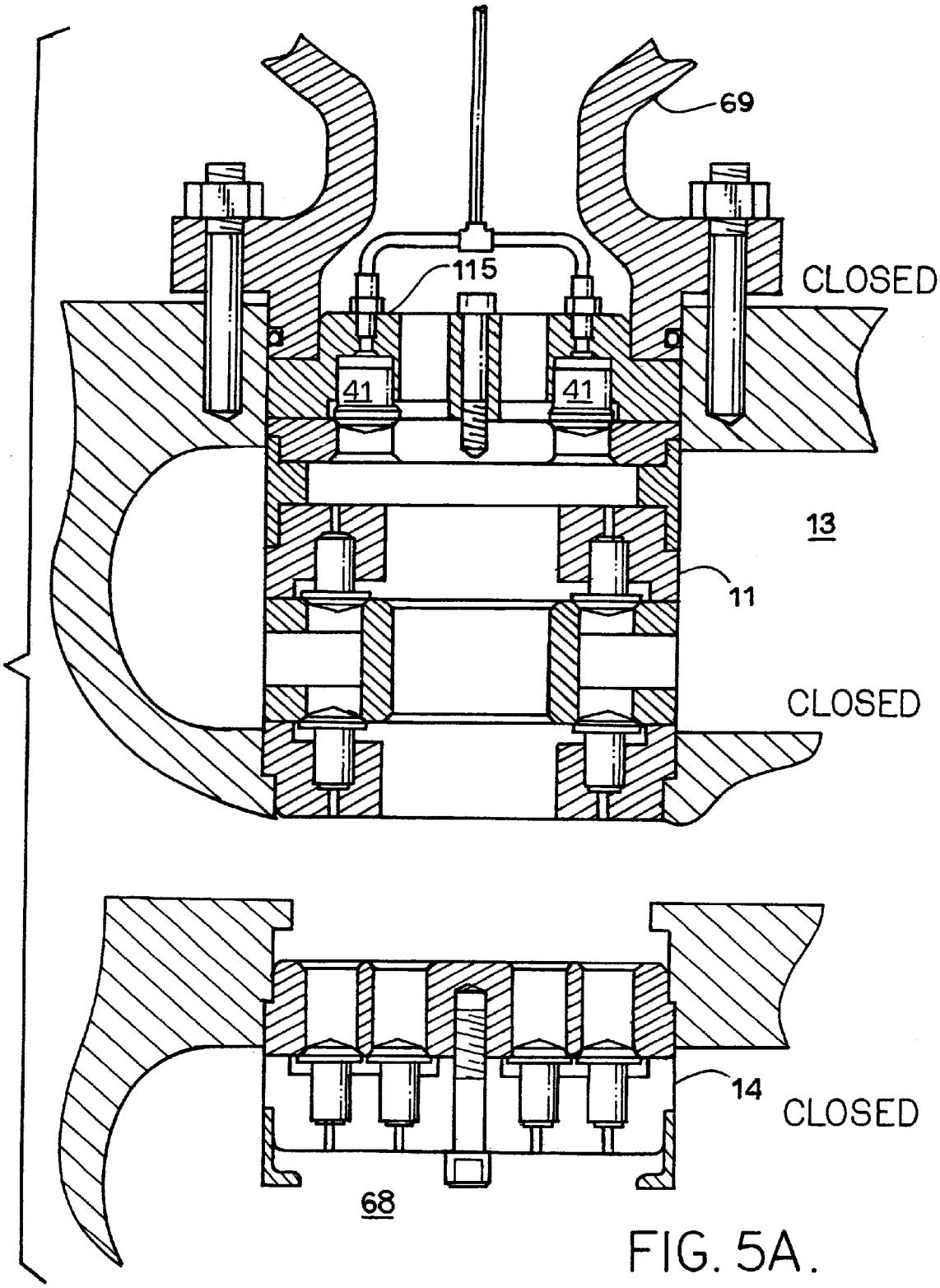
FIG. 5*a* is an enlarged, cross-sectional view showing the unloader valve assembly closed, the suction valve assembly closed and the discharge valve assembly closed.
Figure 5B:
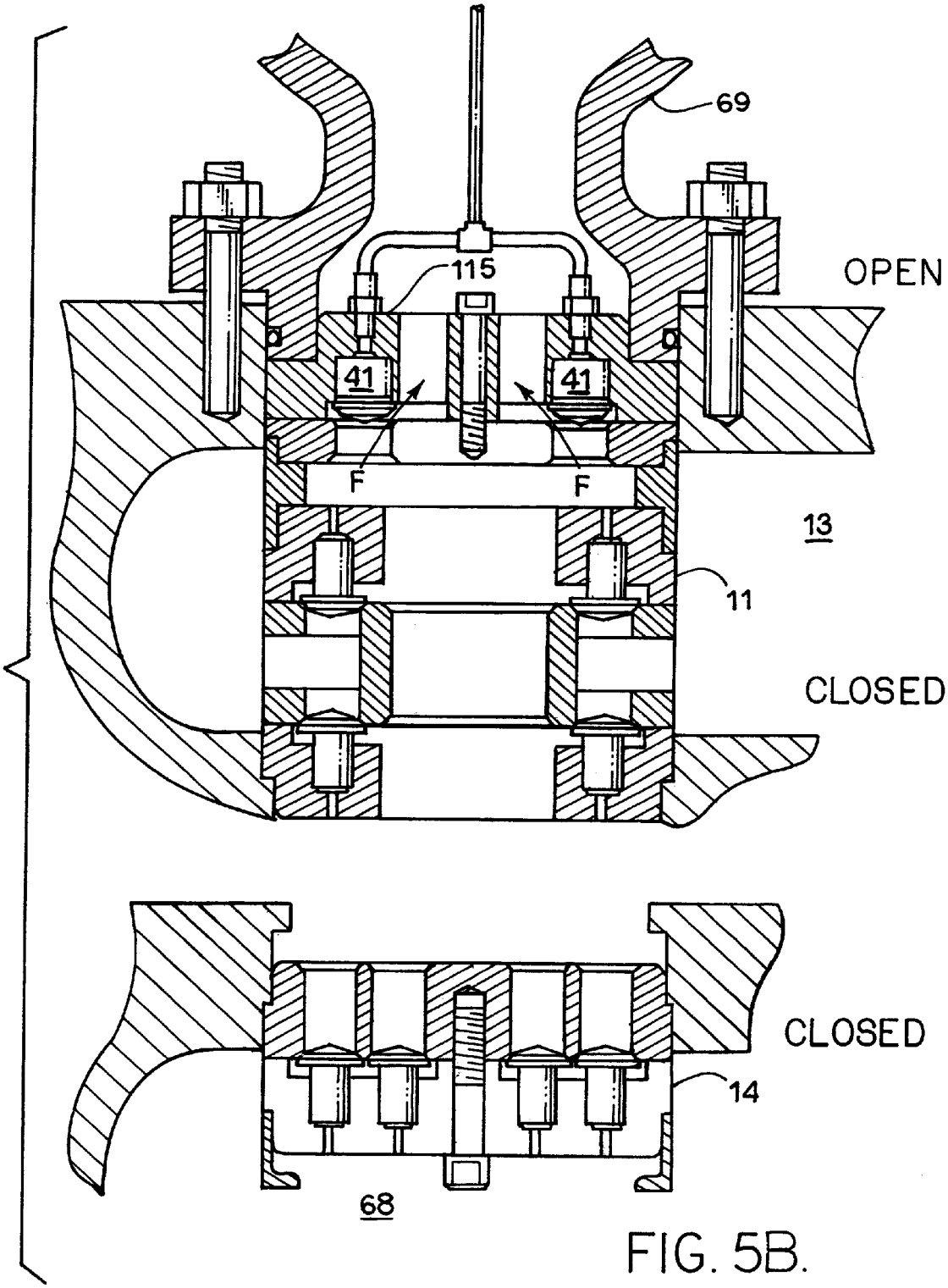
FIG. 5*b* is an enlarged, cross-sectional view showing the unloader valve assembly open, the suction valve assembly closed and the discharge valve assembly closed.

Following trace T.2 in detail, point C represents the beginning point of the cycle. The piston 7 is at bottom dead center; the intake valve assembly 11, the unloader valve assembly 15, and the discharge valve assembly 14 are all closed. This arrangement of the valves is depicted in FIG. 5*a*. Moving along trace T.2 from C to C1, the piston 7 has begun its compression stroke and the pressure in the cylinder 5 begins to rise. At point C1 the pressure in the cylinder 5 reaches the control pressure set point $P_{ctrl.1}$ and the poppet valve members 41 of the unloader valve assembly 15 are forced open. This second arrangement of the valves is shown in FIG. 5*b*, with fluid flow through the valves being indicated by arrows F. The opening of the unloader valve assembly 15 increases the clearance volume of the compressor 3 and slows the rate at which the pressure in the cylinder 5 is rising. This shifts the PV trace off of line C1-D and onto line C1-D1.

Figure 5C:
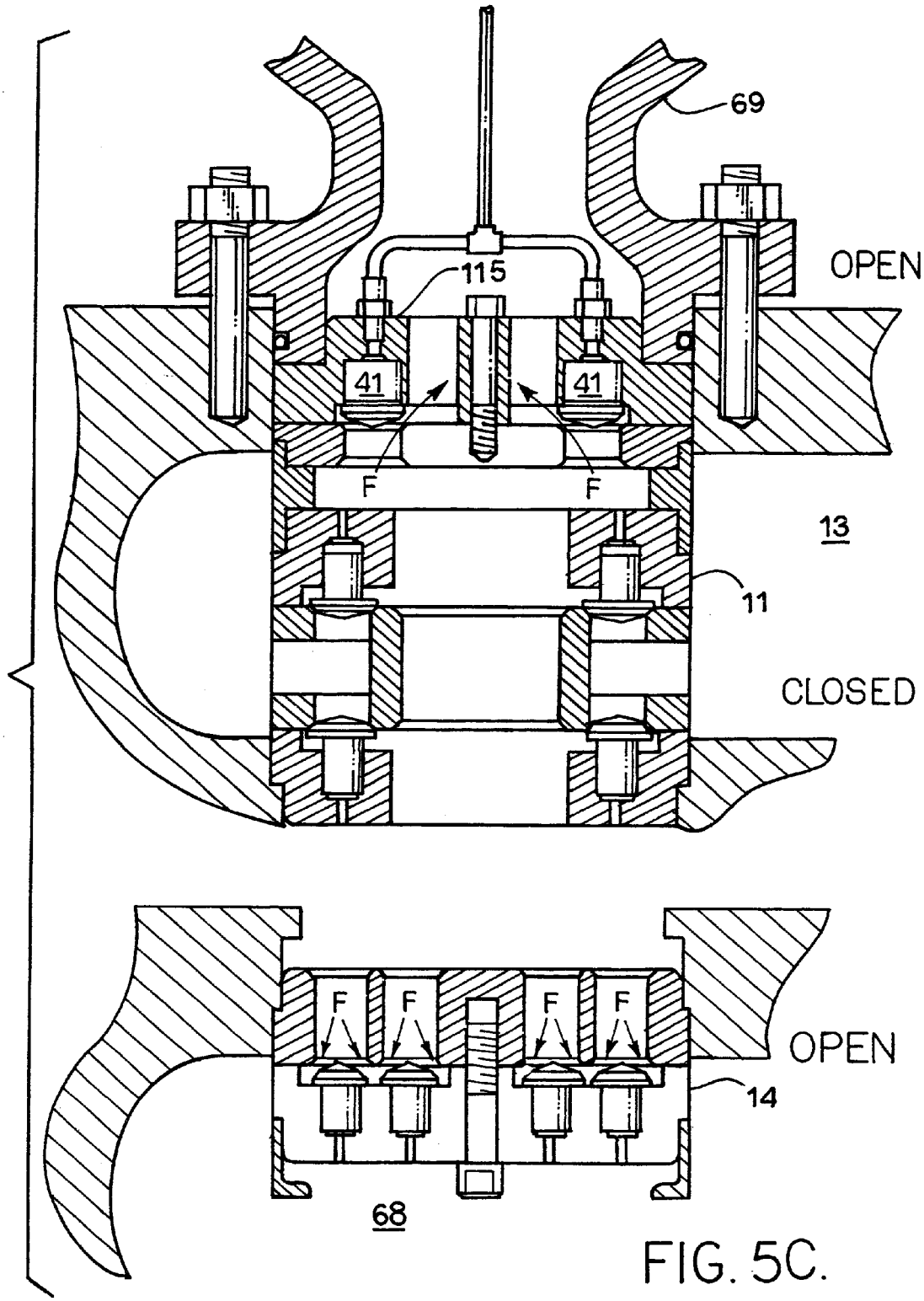
FIG. 5*c* is an enlarged, cross-sectional view showing the unloader valve assembly open, the suction valve assembly closed and the discharge valve assembly open.

At point D1 the discharge valve assembly 14 opens (FIG. 5*c*) and the pressure in the cylinder 5 reaches its maximum level $P_{disc}$. The piston 7 continues its travel until it reaches top dead center at point A. At point A the discharge valve 14 closes (FIG. 5*b*) and the piston 7 begins its expansion stroke (moving from A toward Al) and the pressure in the cylinder 5 begins to drop. At point Al the pressure in the cylinder 5 again reaches the control pressure set point $P_{ctrl.1}$ and the poppet valve members 41 of the unloader valve assembly 15 are allowed to close (FIG. 5*a*). The closing of the unloader valve assembly 15 decreases the clearance volume and thereby increases the rate at which the pressure in the cylinder 5 is dropping and shifts the PV trace off of line A1-B3 and onto line A1-B1. Because the poppet valve members 41 only travel a short distance between the open and closed positions, any delay involved in the shifting of the PV trace is minimal.

Figure 5D:
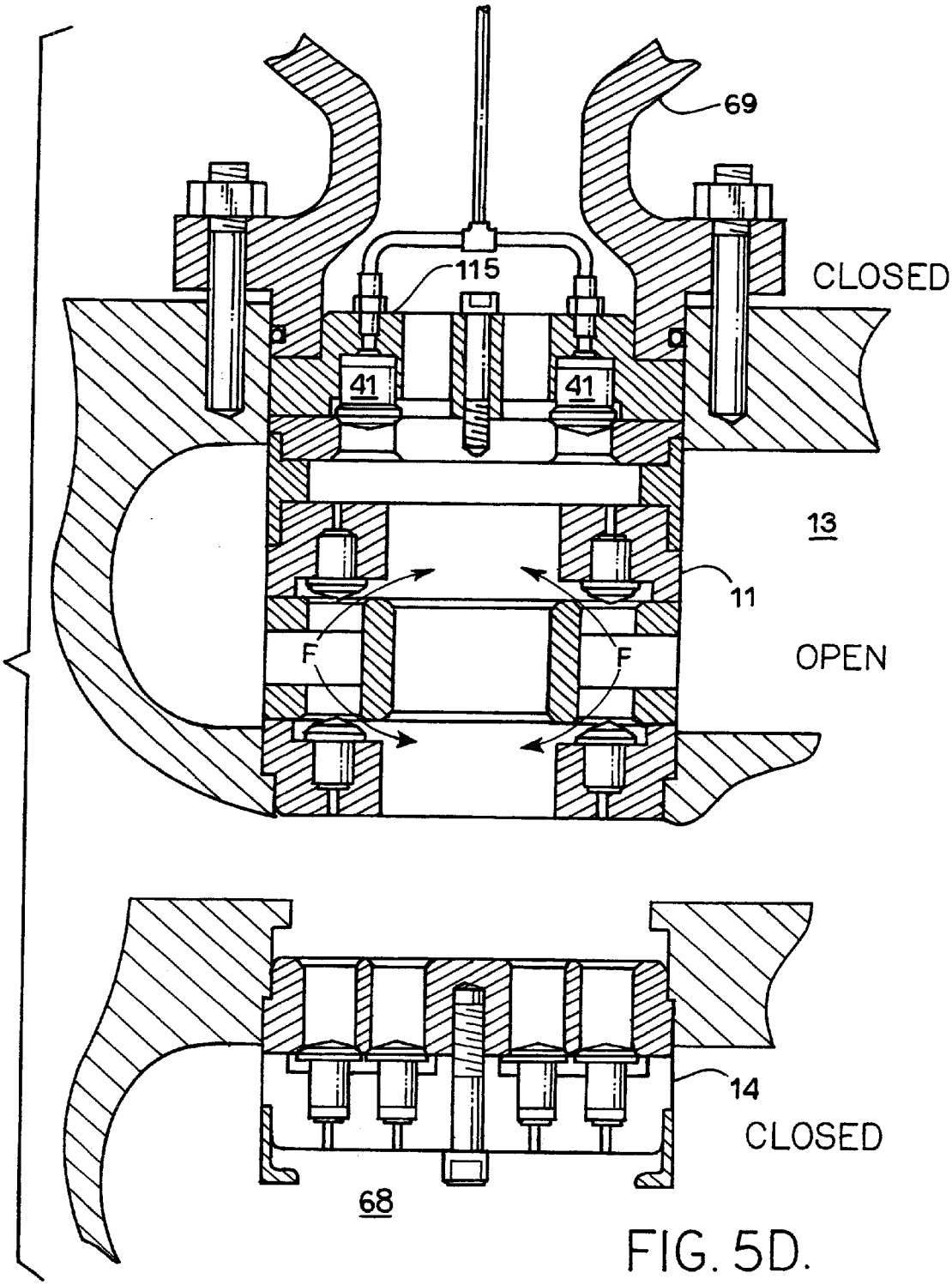
FIG. 5*d* is an enlarged, cross-sectional view showing the unloader valve assembly closed, the suction valve assembly open and the discharge valve assembly closed.

At point B1 the suction valve assembly 11 opens (FIG. 5*d*), and the pressure in the cylinder 5 reaches its minimum level, $P_{suct}$. The piston 7 continues its travel until it again reaches bottom dead center at point C, at which point the suction valve assembly 11 closes.

Trace T.3 (A-A2-B2-C-C2-D2-A) represents opening and closing the unloader valve assembly 15 at a lower pressure $P_{ctrl.2}$, corresponding to a greater flow reduction through the compressor 3. The control pressure set point $P_{ctrl}$ can be infinitely varied between the suction line pressure $P_{suct}$ and the discharge pressure $P_{disc}$. This allows the operating cycle of the compressor to be precisely tailored to meet its demands by simply adjusting the pressure regulator 65.

V. TEST RESULTS

Initial field testing has been performed on a Worthington UTC-7 compressor operating between 600 psi suction and 850 psi discharge. The test was conducted on the crank end of one of three compressor cylinders using a single 1160 cubic inch clearance pocket designed to be used as a fully open or fully closed pocket. By adjusting the control pressure set point $P_{ctrl}$ within the design range, the horsepower and flow were varied as shown in Table 1. The left hand column of Table 1 shows the crank end horsepower required to run the compressor; the second column shows the discharge flow rate from the crank end, and the third column shows the horsepower required per unit of flow from the crank end. The right hand column shows the horsepower required per unit of flow from the head end of the compressor, which was not fitted with the variable clearance system 1.

The top row of Table 1 depicts the minimum load performance of the compressor with the control pressure set to hold the unloader valve assembly open throughout the cycle of the compressor. Succeeding rows show performance as the unloader valve assembly closes off the clearance cavity at progressively earlier points in the cycle. The bottom row shows fully loaded performance with the clearance pocket isolated from the cylinder throughout the cycle except during the discharge event.

TABLE 1

| CE Horsepower | CE Flow (MMSCFD) | CE HP/MM | HE HP/MM |
|---|---|---|---|
| 123.6 (pocket open) | 7.50 | 16.48 | 16.00 |
| 128.8 | 7.83 | 16.45 | 16.10 |
| 136.9 | 8.30 | 16.49 | 16.25 |
| 150.4 | 9.26 | 16.24 | 16.32 |
| 158.2 | 10.07 | 15.71 | 16.16 |
| 174.5 (pocket closed) | 10.94 | 15.95 | 15.89 |

The test results indicate that the variable clearance system 1 can be used effectively to vary the flow rate from a reciprocating compressor to meet the requirements of its specific operating conditions. There was some variation in HP/MM (which is a measure of efficiency) on the crank end, but not significantly different than was present on the head end of the same cylinder that had no load changes occurring. The slight changes could have resulted from small incidental changes in the operating conditions.

It appears that there is really no limit on applying this system to reciprocating compressors. It has been tested to document the ability to effectively vary the clearance of fixed cavity size pockets. This can certainly be adapted to effectively vary the clearance on the head end pockets on high speed compressors. This allows most any compressor to be fully automated, with improved fuel consumption and reduced emissions resulting from the smoother loading and unloading.

VI. SECOND MODIFIED EMBODIMENT UNLOADER SYSTEM 201

Figure 6:
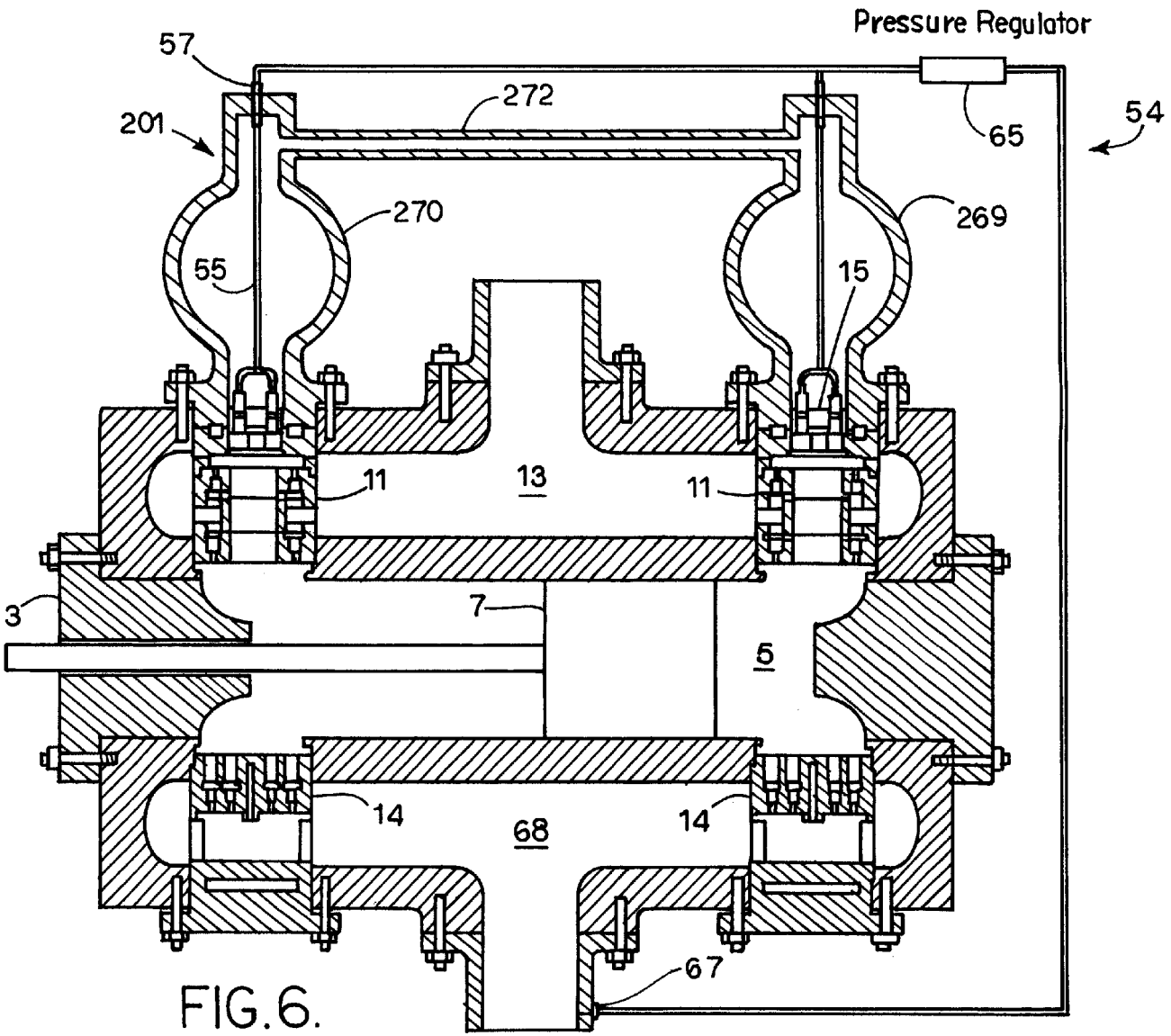
FIG. 6 is a cross-sectional view of a reciprocating gas compressor with an unloader system comprising a second modified embodiment of the present invention with fluidically interconnected clearance bottles.

An unloader system 201 comprising a second modified embodiment of the present invention is shown in FIG. 6. Suction valve assemblies 11 and unloader valve assemblies 15 are installed in both suction valve pockets 9 of the compressor cylinder 5. Clearance bottles 269 and 270 are mounted in communication with the unloader valve assemblies 15. A runner 272 interconnects the clearance bottles 269 and 270.

By interconnecting the clearance bottles 269 and 270, the available clearance volume is significantly increased. There is no risk of short-circuiting the compressor because the two unloader valve assemblies 15 will never be open at the same point in the compressor cycle.

VII. FEEDBACK CONTROL SYSTEM

Figure 7:
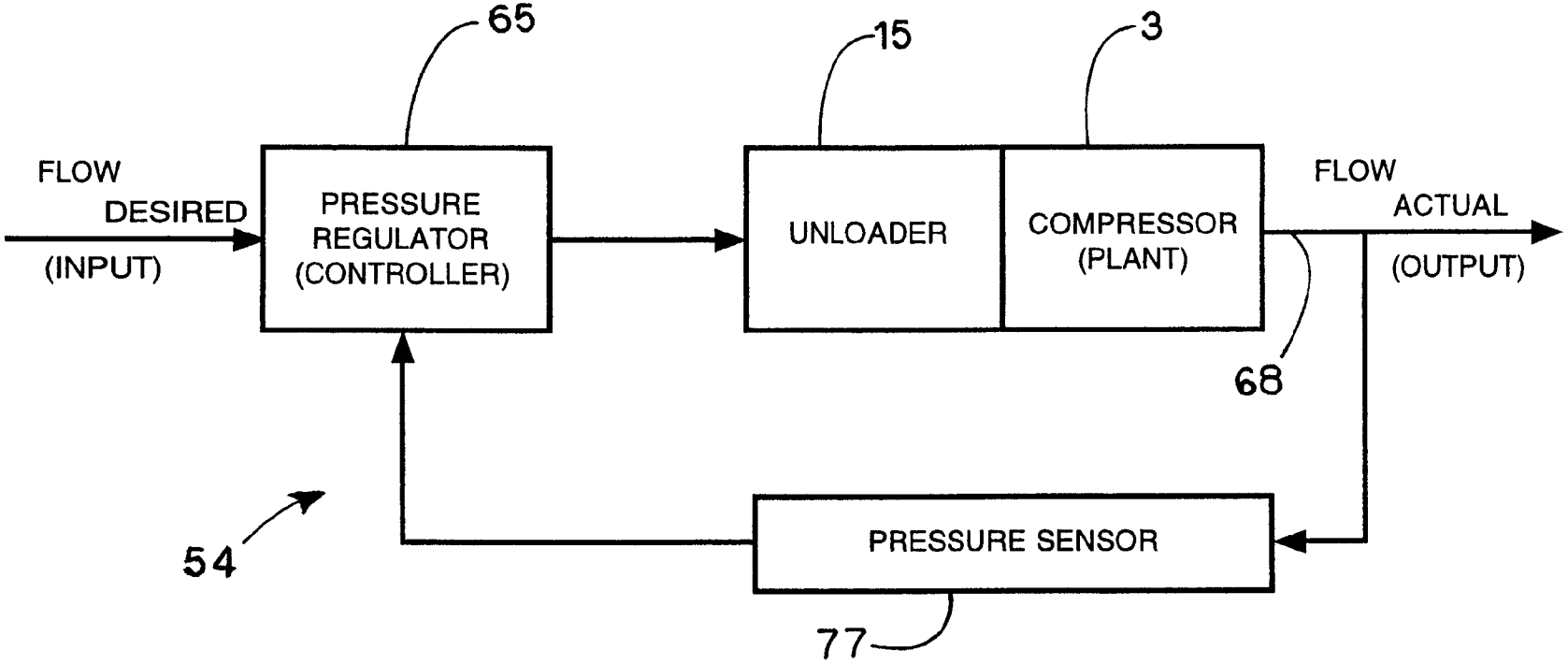
FIG. 7 is a block diagram of a closed-loop feedback control system for controlling the operation of the compressor by means of the unloader system of the present invention.

The pressure regulator 65 can be a mechanical, analog electrical or digital electronic device which may be controlled manually or electronically. An example of a suitable electronic pressure controller would be the ER3000 series produced by the TESCOM Corporation of Elk River, Minn. If a pressure sensor 77 is added to the system and placed in communication with the discharge line 68 of the compressor 3 then a closed-loop feedback control system can be created. A block diagram of such a system is shown in FIG. 7.

For each set of operating conditions, the operator of the system can determine an optimum flow which is calculated to most efficiently meet the downstream demand for natural gas, and this desired flow becomes the input for the control system. The desired flow corresponds to a desired discharge pressure $P_{disc}$. This information is communicated to the controller of the pressure regulator 65, which determines the proper control pressure set point $P_{ctrl}$ to achieve the desired discharge pressure $P_{disc}$. The pressure regulator 65 is then adjusted to the new control pressure set point $P_{ctrl}$ which effects the timing of the opening and closing of the unloader valve assembly 15. Any change in the timing of the unloader valve assembly 15 directly effects the actual flow from the discharge line 68 of the compressor 3 which is the output of the system.

The pressure sensor 77 reads the actual discharge line pressure $P_{disc}$ and the actual pressure is compared to the desired pressure. If the actual pressure is not the same as the desired pressure, this information is communicated back to the pressure regulator 65 and the control pressure set point $P_{ctrl}$ can be adjusted to compensate for the difference.

What is claimed and desired to be secured by Letters Patent is as follows:

1. An unloader system for a reciprocating compressor including a cylinder, a piston reciprocably mounted in the cylinder, a rotatable crankshaft connected to the piston, a suction line, a discharge line, a suction valve assembly, and a discharge valve assembly for selectively communicating the suction and discharge lines respectively with the compressor cylinder, and a cycle with compression and re-expansion strokes, which unloader system comprises:

a. an unloader valve assembly having an inboard side and an outboard side, said inboard side communicating with said compressor cylinder;

b. means for varying the unloading of the compressor to a desired level by adjustably and automatically opening said unloader valve assembly during said compression stroke and closing said unloader valve assembly during said re-expansion stroke, said means for varying being connected to said compressor and being adapted to actuate said unloader valve assembly in response to an operating condition of the compressor; and c. A clearance cavity in selective communication with said compressor cylinder through said unloader valve assembly.

2. An unloader system as in claim 1, wherein said control system operates without reference to compressor crankshaft position.

3. An unloader system as in claim 2, wherein said control system provides a pressure differential across said unloader valve assembly, said pressure differential cycling with said compressor.

4. An unloader system as in claim 3, wherein said pressure differential varies automatically in synchronization with said compressor cycle.

5. An unloader system as in claim 4, wherein said pressure differential is adjustable independent of said compressor cycle.

6. An unloader system as in claim 5, wherein said control system is pneumatic.

7. An unloader system as in claim 6, wherein said pneumatic control system includes a pressure regulator for adjusting a control pressure set point at which said unloader valve assembly opens and closes in response to said pressure differential.

8. An unloader system as in claim 7, wherein said pneumatic control system includes a pressure sensor in communication with said compressor discharge line, said pressure sensor providing feedback to said pressure regulator.

9. An unloader system as in claim 7, wherein said unloader valve assembly includes:

a. a valve seat structure;

b. a valve guard mounted on said valve seat structure; and c. a valve member movably mounted in said valve guard between open and closed positions and having an upstream side engaging said valve seat structure in its closed position and a downstream side.

10. An unloader system for a reciprocating compressor including a cylinder, a piston reciprocably mounted in the cylinder, a rotatable crankshaft connected to the piston, a suction line, a discharge line, a suction valve assembly and a discharge valve assembly for selectively communicating the suction and discharge lines respectively with the compressor cylinder, which unloader system comprises:

a. an unloader valve assembly including inboard and outboard sides, said inboard side communicating with said compressor cylinder, which includes:

i. a valve seat structure having an inboard side, an outboard side, and multiple seat passages;

ii. a valve guard having an inboard side and an outboard side, multiple poppet valve stem bores, a valve head clearance along said inboard side, ports connecting said poppet valve stem bores with said valve guard outboard side, and a fluid passage allowing communication between said valve head clearance and said valve guard outboard side, said valve guard being mounted on the outboard side of said valve seat structure; and iii. a plurality of poppet valve members movably mounted in said valve guard between open and closed positions with respect to said seat passages, each said poppet valve member having a head and a stem, said head engaging the outboard side of said valve seat structure in its closed position;

b. a control manifold having an inboard end and an outboard end, a branch for each said valve stem bore on said inboard end, and each said branch communicating with said poppet valve stem bores through said ports in the valve guard;

c. a pressure regulator in communication with the outboard end of said control manifold;

d. a pressure source in communication with said pressure regulator; and e. a clearance bottle mounted in communication with the outboard side of said unloader valve assembly.

11. An unloader system as in claim 10, wherein said poppet valve members are non-metallic.

12. An unloader system as in claim 10, wherein said poppet stem bores are the same diameter as said seat passages.

13. An unloader system as in claim 10, wherein:

a. said valve seat structure has chamfered valve seats where said seat passages intersect said outboard side;

b. said valve guard has chamfered valve seats where said poppet valve stem bores intersect said valve head clearance; and c. said poppet valve member head has an inboard side and an outboard side, said inboard side and said outboard side each having a beveled seating surface, said outboard beveled seating surface engaging the chamfered valve seat of said valve seat structure in its closed position and said inboard beveled seating surface engaging the chamfered valve seat of said valve guard in its open position.

14. An unloader system as in claim 10, wherein:

a. each said poppet valve stem bore has a valve head clearance and a fluid passage allowing communication between said valve head clearance and said valve guard outboard side;

b. said valve guard has a center hole;

c. said valve seat structure has a threaded receiver in alignment with said center hole; and d. an axial attaching bolt passes through said center hole and threadably engages said threaded receiver.

15. An unloader system as in claim 10, wherein said unloader system includes a pressure sensor in communication with said compressor discharge line, said pressure sensor providing feedback to said pressure regulator.

16. An unloader system as in claim 10, wherein said unloader system includes:

a. a plurality of said unloader valve assemblies;

b. a plurality of said clearance bottles; and c. a runner interconnecting said clearance bottles.

17. A method of unloading a reciprocating compressor including a cylinder, a piston reciprocably mounted in the cylinder, a rotatable crankshaft connected to the piston, a suction line, a discharge line, a suction valve assembly and a discharge valve assembly for selectively communicating the suction and discharge lines respectively with the compressor cylinder, and said cylinder, suction line and discharge line each having a respective internal pressure, which unloading method comprises the steps of:

a. providing an unloader valve assembly with a valve member movably mounted between open and closed positions, wherein cylinder pressure exerts a force on a first side of said valve member;

b. providing a control pressure which exerts a force on a second side of said valve member in opposition to the force exerted by cylinder pressure, said control pressure having a set point;

c. providing a pressure regulator for adjusting said control pressure set point;

d. adjusting said control pressure set point so that said unloader valve assembly opens when the force exerted on said first side of said valve member exceeds the force exerted on said second side and closes when the force exerted on said first side drops below the force exerted on said second side; and e. providing a clearance bottle in selective communication with said compressor cylinder through said unloader valve assembly.

18. An unloading method as in claim 17 which includes the additional steps of:

a. determining a desired discharge line pressure;

b. providing a pressure sensor in communication with said compressor discharge line;

c. generating a feedback signal corresponding to the discharge line pressure;

d. transmitting said feedback signal to a controller;

e. having said controller determine if a differential exists between the discharge line pressure and the desired discharge line pressure; and f. adjusting said pressure regulator to compensate for said differential.

19. An unloader system for a reciprocating compressor including a cylinder, a piston reciprocably mounted in the cylinder, a rotatable crankshaft connected to the piston, a suction line, a discharge line, a suction valve assembly, and a discharge valve assembly for selectively communicating the suction and discharge lines respectively with the compressor cylinder, which unloader system comprises:

a. a clearance cavity in communication with the compressor cylinder though a passageway; and b. an unloader valve having a valve member moveable between open and closed positions and controlling flow through said passageway, said valve member having opposed first and second ends, said first end being acted on by pressure in the compressor cylinder, said pressure producing a first force which acts to urge said valve member toward said open position, said second end aced on by a selectively variable force acting in opposition to said first force and acting to urge said valve member toward said closed position, said valve member moving to said open position when said first force exceeds said selectively variable force and moving to said closed position when said selectively variable force exceeds said first force.

* * * * *